US006520585B1

(12) United States Patent
Georg et al.

(10) Patent No.: US 6,520,585 B1
(45) Date of Patent: Feb. 18, 2003

(54) MEDICAL OR DENTAL-MEDICAL TREATMENT CHAIR OR A HEAD SUPPORT FOR SUCH A TREATMENT CHAIR

(75) Inventors: Hummler Georg, Biberach-Ringschnait (DE); Von Bank Reinhold, Schemmerhofen (DE); Rapp Karlheinz, Mittelbiberach (DE)

(73) Assignee: Kaltenbach & Voight GmbH & Co., Biberach (DE)

( * ) Notice: Subject to any disclaimer, the term of this patent is extended or adjusted under 35 U.S.C. 154(b) by 28 days.

(21) Appl. No.: 09/813,733

(22) Filed: Mar. 21, 2001

(30) Foreign Application Priority Data

Mar. 22, 2000 (DE) ..... 100 14 063

(51) Int. Cl.[7] ..... A61G 15/00; A47C 7/36
(52) U.S. Cl. ..... 297/408; 297/409
(58) Field of Search ..... 297/408, 409

(56) References Cited

U.S. PATENT DOCUMENTS

| | | | | |
|---|---|---|---|---|
| 2,630,887 A | | 3/1953 | Paquin | |
| 5,315,726 A | * | 5/1994 | Borenstein | 297/408 X |
| 5,927,804 A | * | 7/1999 | Cuevas | 297/408 X |

FOREIGN PATENT DOCUMENTS

| | | | | |
|---|---|---|---|---|
| DE | 2232726 | * | 1/1974 | 297/408 |
| DE | 29 32 345 A1 | | 2/1981 | |
| DE | 2935345 | * | 2/1981 | 297/408 |
| DE | 296 20 800 U1 | | 3/1998 | |
| EP | 0 673 633 A2 | | 3/1995 | |
| EP | 0 701 806 A1 | | 3/1996 | |
| FR | 2 367 482 | | 5/1978 | |

OTHER PUBLICATIONS

English language abstract of EP 0 673 633 A2.

English language abstract of DE 296 20 800 U1.

English language abstract of DE 29 32 345 A1.

English language abstract of FR 2 367 482.

* cited by examiner

*Primary Examiner*—Rodney B. White
(74) *Attorney, Agent, or Firm*—Marshall Gerstein Borun

(57) ABSTRACT

A medical or dental-medical treatment chair has a backrest and a head support. The head support is pivotally connected with the backrest by means of a joint device having a first joint, and being fixable in a respective pivot position by means of a fixing device. For improving the support function, the fixing device has a piston cylinder with two working chambers. The piston cylinder is connected with joint parts of the first joint. The working chambers are connected with one another by means of a connection line in which a valve is disposed that can be selectively opened and closed. An actuating member is provided for the selective opening and closing of the valve.

16 Claims, 6 Drawing Sheets

MEDICAL OR DENTAL-MEDICAL TREATMENT CHAIR OR A HEAD SUPPORT FOR SUCH A TREATMENT CHAIR

This patent is based on German national application number DE 100 14 063.7, which was filed on Mar. 22, 2000.

FIELD OF THE INVENTION

The present invention relates to a medial or a medical-dental treatment chair and to a head support for such a treatment chair.

BACKGROUND OF THE INVENTION

A treatment chair or a head support of these kinds are described in DE 296 20 801 U1. With this known treatment chair or with this known head support, for the setting of the head support there is provided a pivoting device in the form of a four-bar chain, there being likewise present an associated fixing device for fixing the pivoting device in the respective pivot position. The fixing device has a coupling in the region of the base joint of the four-bar chain, with a coupling element movable between a coupling position and a decoupling position for the selective fixing or blocking and release of the joint. There is provided on the head support a manually movable actuating member for opening and/or closing the coupling, which is connected with the coupling via a cable line. Further, there is associated with the coupling a blocking device having a blocking part which prevents the opening of the coupling when the actuating member is not actuated and allows opening upon actuation of the actuating member.

From EP 0 701 806 A1 there is likewise disclosed a treatment chair or a head support of the kind indicated in the introduction. With this known configuration the pivot device has a link having two joints in its end regions, which by means of its base joint having a head support holder of an associated backrest and in its second joint carries the head support. There is associated with the joints a fixing device having a pneumatic piston cylinder with a working chamber for clamping the joints. The piston cylinder can be acted upon and activated by means of the pneumatic pressure of a hand pump. For a fixing clamping of the joints there is needed a considerable clamping force, since in functional operation the head support is subject to considerable loads which can be applied thereto mainly by the patient and which seek to move the head support. There are thus necessary considerable fixing forces in order to secure the head support in its set position. A further disadvantage of this known configuration consists in that a complex handling procedure is needed to set the head support in the respective desired position. For this, both operating hands are unavoidably needed, the head support being adjusted and positioned with the one operating hand and the pneumatic pressure member being actuated with the other operating hand.

SUMMARY OF THE INVENTION

A treatment chair or a head support of the kinds indicated in the introduction is also described in EP 0 673 663 A2. With this known configuration, the pivoting device of the head support is formed by means of a so-called four-bar chain whereby there is associated with the base joint connecting the pivoting device with the backrest a coupling for blocking the joint, which can be opened by means of a manual actuation of an actuating member movably mounted on the head support. The actuating member is, with this known configuration, a tiltably mounted part, which can be tilted with the operating hand. The actuating member is connected with the coupling by means of a cable line, so that the tilting movement can be exploited for opening the coupling.

The object of the invention is, with a treatment chair or a head support of the kinds indicated in the introduction, to improve the support function. The manufacturing outlay and/or the handling effort for adjusting and setting the head support should be small. Further, the head support should be stable in its set position, so that the risk of an unintended movement is avoided or reduced.

These and other object, features, and advantages of the present invention are achieved by a medical of a dental-medical chair and a head support for such a chair. The chair has a backrest and a head support. The head support is pivotally connected with the backrest by a joint device that has a first joint. The joint device can be fixed in a respective pivot position by a fixing device.

The fixing device has a piston cylinder that blocks the associated joint in a set position. Even with greater loads on the head support, the positioning thereof in the set position is ensured. Particularly suitable is a piston cylinder with working chambers that are filled with a fluid such as oil, which has limited compressibility and, therefore, brings about the blocking of the piston cylinder and thus of the joint. For removing this lock a slight effort may be needed. For example, a slight manual actuation may be needed, such as opening a valve in a connection line connecting the working chambers with one another. This measure can be effected with a slight effort or application of force and with a small movement so that the opening and closing of the valve can be readily carried out. Piston cylinders of this kind are per se known components that are obtainable in the market for technical goods and to date have been employed for other purposes.

A further development of the invention makes possible an adjustment and setting of the head support likewise with a slight effort in terms of handling, whereby it is further possible to adjust the head and set it in the desired position support with one-handed operation. Here, the head support can be grasped in a readily manipulable manner, by means of gripping over the grip part carrying the actuating member and over the actuating member, preferably from the side, and the head support can be guided in its setting movement. Thereby the actuating member can be moved, in particular pushed in, into its release position, by means of the thumb of the operating hand or with at least one opposing finger. In this gripping position the head support at the same time finds a firm hold in the operating hand, which makes it possible to move the head support both about the first joint and also about the second joint into the desired support position. In this position there is needed only a pressure release or a letting go of the actuating member, whereby the actuating member is self-actingly moved into its locking position due to its elastic return force, in which locking position the joint is blocked. A further advantage of this configuration consists in that it is suitable both for right-handed and also for left-handed persons.

It is possible to provide the configuration in accordance with the invention for the first joint and/or for the second joint. When respective piston cylinders in accordance with the invention are associated with each of the two joints it is particularly advantageous to provide a common actuating member for both piston cylinders, so that both joints are unlocked by means of the actuation of the actuating member and upon letting go of the actuating member are locked or blocked. With this configuration the head support is settable in a particularly readily manipulable manner, since with a simultaneous movement of both joints selective support positions can be set with one manual movement. In this connection it is moreover of advantage to form the actuating member with an actuating surface extending parallel to the plane of movement of the joints, which actuating surface is so large that is capable of actuating the associated valve members in any pivot position.

Further, the configurations in accordance with the invention distinguish themselves in a simple, compact and economically manufacturable construction, which can be integrated in a simple manner in the setting device and which makes possible a reliable functioning.

BRIEF DESCRIPTION OF THE DRAWINGS

Below, the invention and further advantages which can be achieved thereby will be explained in more detail with reference to preferred configurations. There are shown.

Figure 1:
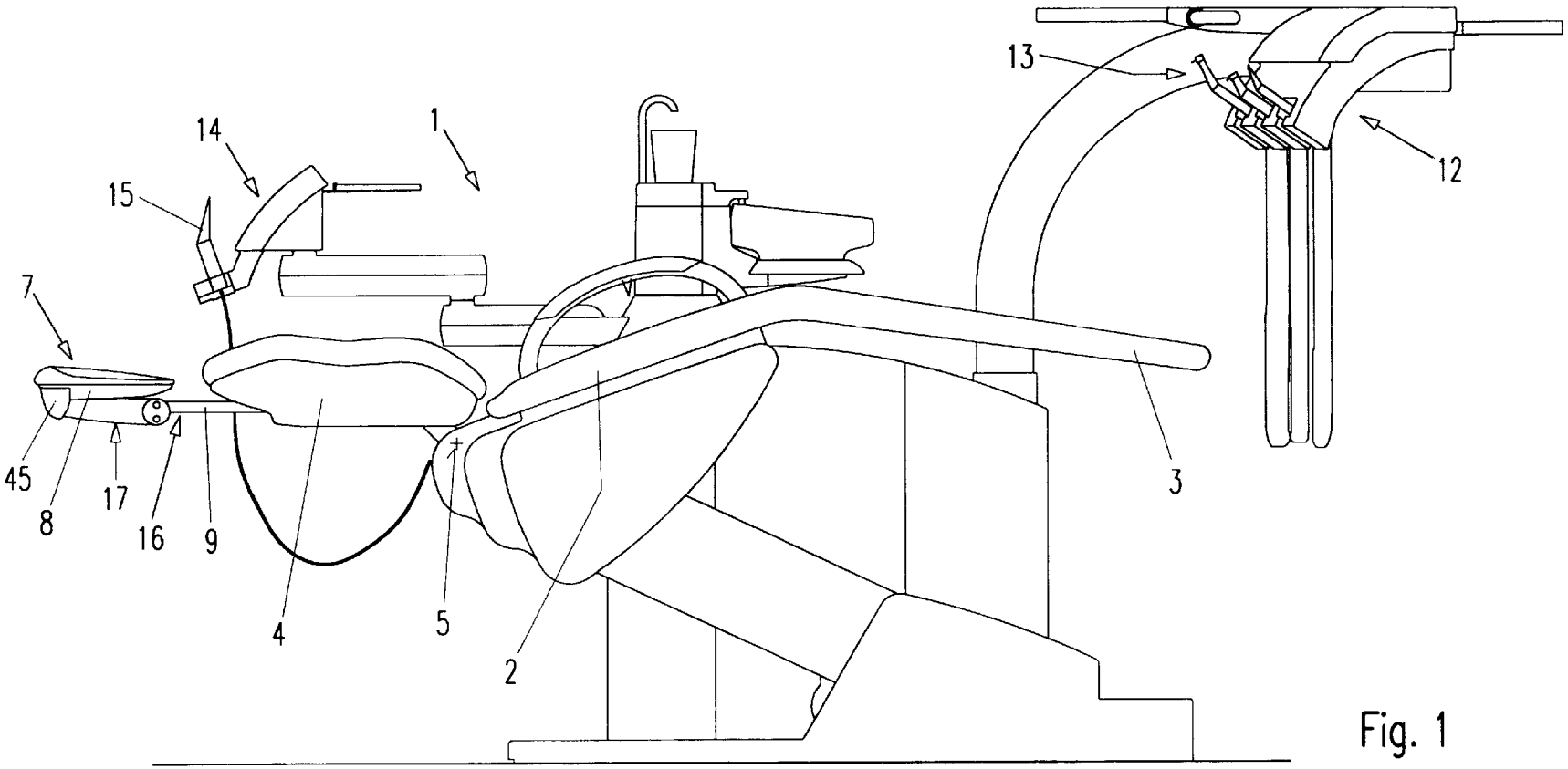
FIG. 1 shows a treatment chair in accordance with the teachings of the present invention and viewed from the side.

The main parts of the dental or medical treatment chair, designated overall by 1, are a seat part 2, preferably settable in position in its vertical longitudinal middle plane E, having a leg support 3, a backrest 4, which at the rearward end of the seat part 2 is connected with the seat part 2 by means of a backrest joint 5 having a horizontal joint axis extending transversely of the treatment chair 1 and which, by means of a first setting device not shown in detail, can be moved around the joint axis between an upright sitting position and an approximately horizontal lying position, and which can be fixed in the respective adjusted position by means of a first fixing device, a head support 7 having a base body 8 which is adjustably mounted on the backrest 4 by means of one or two carrier rods 9 extending in the longitudinal direction of the backrest 4. 12 designates an adjustable first carrier for treatment instruments 13, which are mainly used by the dentist, and 14 designates a second adjustable carrier for treatment instruments 15, which are mainly used by an assistant.

DETAILED DESCRIPTION OF THE PREFERRED EMBODIMENTS

Figure 2:
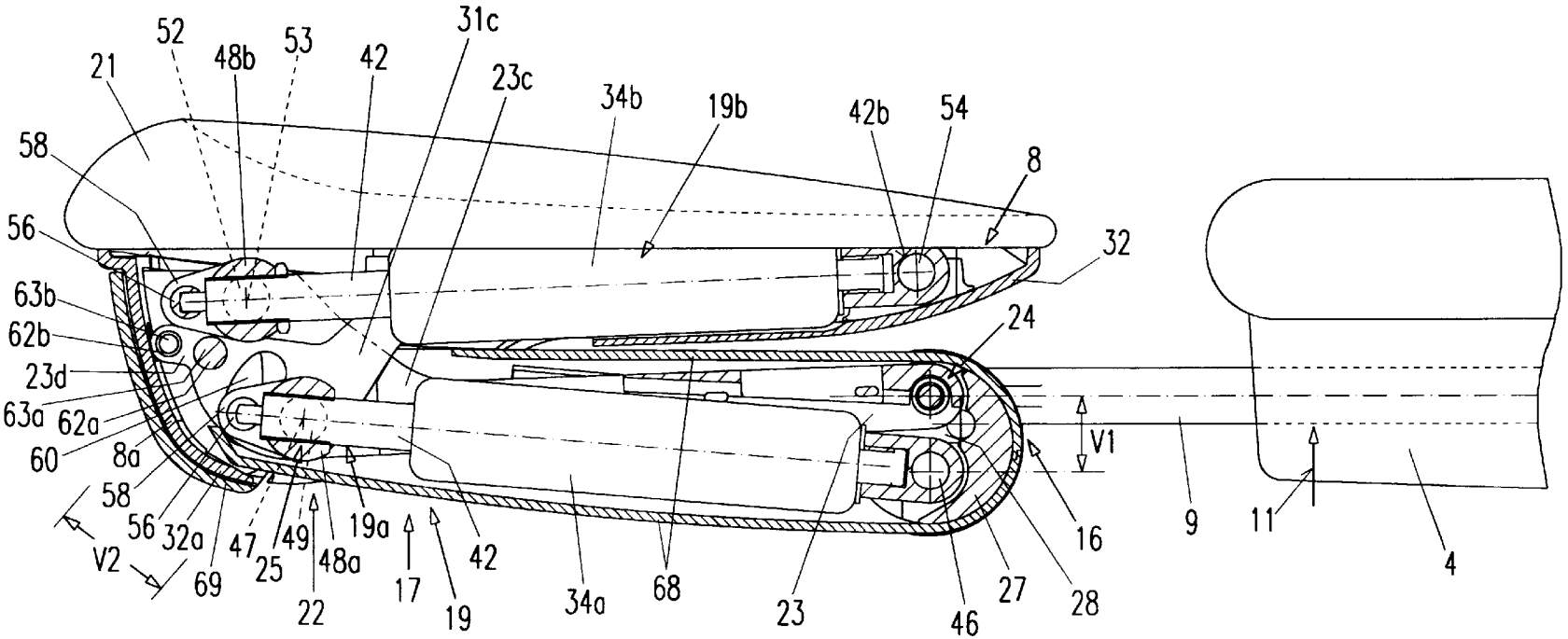
FIG. 2 shows a head support of the treatment chair of FIG. 1 in an enlarged illustration viewed from the side.
Figure 3:
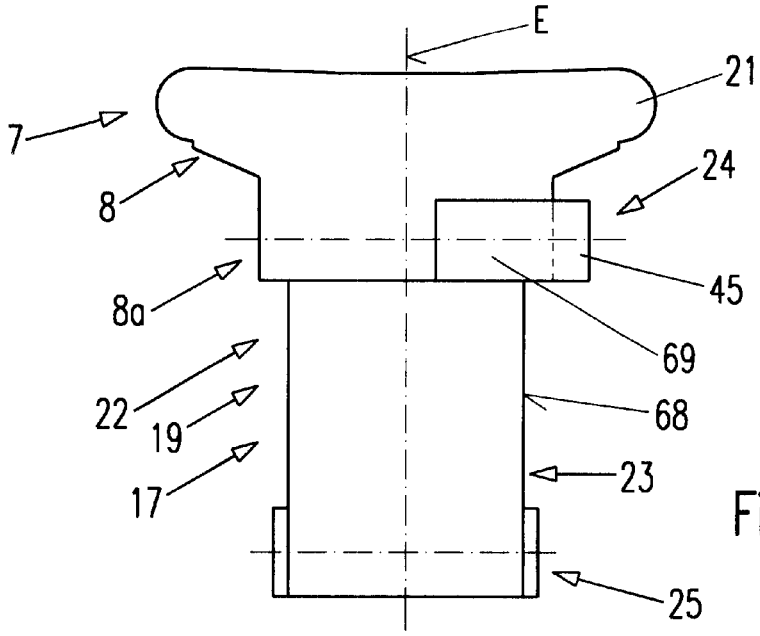
FIG. 3 shows the head support of FIG. 2 viewed from behind.

The carrier rods 9 extending in the longitudinal direction of the backrest 3, which are adjustably connected with the backrest 3 and are fixable by means of a fixing device 11 indicated in FIG. 2 which can be released or overcome with a certain exercise of force, form a head support holder 16. On this holder, the head support 7 is adjustable by means of a pivot device 17 in the vertical longitudinal middle plane E of the treatment chair 1 and is fixably held in the respective pivot position by means of a second fixing device designated overall as 19, in order to set the head support 7, with a cushion 21 arranged at its forward or upward side, in a desired support position with regard to the head of a patient. A second setting device formed in this way is designated overall as 22.

The pivot device 17 has a link 23 which at its one end is connected by means of a first joint 24 with the head support holder 16 to be pivotable in the longitudinal middle plane E, and which is connected at its other end by means of the second joint 25 with a joint part of the base body 8. The link 23 is a so-called open link, i.e. it consists of two link webs 23*a* having a horizontal spacing from one another which are stabilized to a rigid link component by means of a transverse 23*b* arranged preferably at the upper or at the lower end, whereby the ends of the link webs 23*a* extend freely standing out from the transverse 23*b*. The first joint 24 is arranged in a base part 27, here in the form of an approximately cylindrical body, in which a joint recess 28 for the link 23 is located, whereby the joint axis 24*a* with an associated joint bolt is arranged eccentrically, here upwardly offset, in the base part 27. In the region of the end sections of the base part 27, formed by means of the joint recess 28, there are arranged e.g. secantial insertion holes 29 at the transverse spacing of the carrier rods 9, into which these are placed and fixed by means of securing elements.

The joint part of the second joint 25 on the head support side is formed similarly to the link 23 by means of two side base body webs 31*a* of an elongate base carrier 31, on which a base body shell 32 is fixed, which in the region of the second joint 25 has on the lower side a hollow box shaped body part 32*a*, preferably formed on in one piece, and on the upper side carries the cushion 21 which is preferably attached thereon in a manner such it can be releasably clipped off. For this purpose there may be serve one or more press-stud connections, which are not illustrated for reasons of simplicity.

The link webs 23*a* and the base body webs 31*a* have, for forming the second joint 25, web extensions 23*c*, 31*c*, angled upwardly and obliquely downwardly, which engage over one another and in the region of which the second joint 25 is formed, e.g. in that a joint bolt 25 passes through the web extensions in a joint hole and is fixed thereon. For receiving the second joint 25, the base body shell 32 has a recess 33 in the associated region, which recess extends between side body webs 8*b*, running out to the front. By these means there is attained a space-saving or low profile construction as is shown in particular in FIG. 2, in which the link 23 is arranged in a pivoted-in position between the body webs 8*b* at the height thereof, and the base body carrier 31 is located relatively closely above the link 23.

Figure 7:
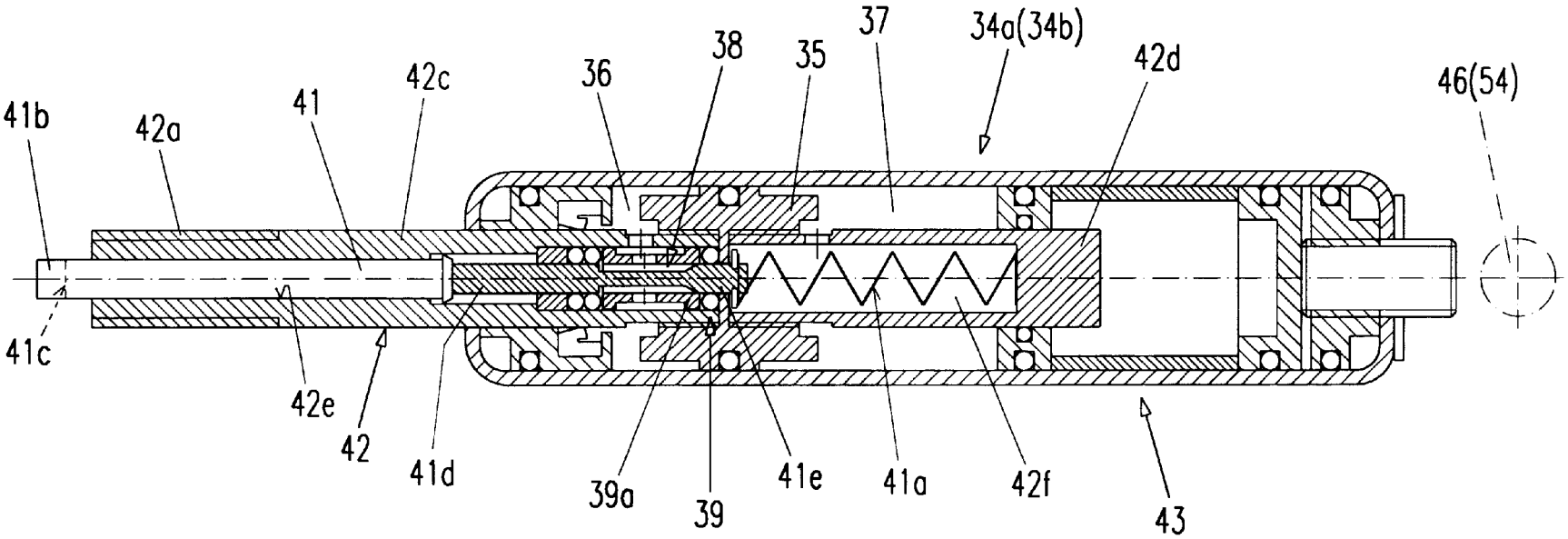
FIG. 7 shows a piston cylinder for the head support of FIG. 2 in an axial cross section and located in a hydraulically locked position of its piston rod.

The fixing devices 19*a*, 19*b* associated with the first and second joints 24, 25 are in principle formed the same as one another, and they have each a piston cylinder 34*a*, 34*b* the working chambers 36, 37 of which, arranged on the two sides of the piston 35, are connected with one another by means of a connection line 38 in which there is arranged a valve 39 to be selectively opened and closed, which can be opened by means of a longitudinally movably guided valve tappet 41 and e.g. closes self-actingly due to a spring force. With the exemplary embodiment according to FIG. 7, the connection line 38 and the valve 39 are arranged in the piston 35, whereby the connection line 38 opens to the two sides of the piston 35 and the valve body of the valve 39 can be displaced into its opened position by means of the valve tappet 41 movably mounted in a longitudinal bore of the piston rod 42. This is effected by means of a pushing in of the valve tappet 41 against the elastic return force of a return spring 41*a*, which returns the valve tappet 41 into its open position illustrated in FIG. 7, in which its contact end 41*b* away from the valve 39 projects beyond the piston rod 42. The free end region of the piston rod 42 has a connection 42*a* in the form of an external thread. The opposing end of the cylinder 43 has a connection element 42*b* which e.g. may be formed in the shape of a screwed-on joint eye having a transversely extending joint hole (FIG. 2) and thus is connected with a joint which will be described below. In FIG. 7, the joint eye is not illustrated, for reasons of simplification. The piston 35 has on both sides coaxially arranged piston rod sections 42*c*, 42*d*, e.g. screwed into the piston, of which one piston rod section 42*c* has an axial through-hole 42*e* in which the valve tappet 41 is axially displaceably mounted. A valve pin 42*d*, bearing on the inner end of the valve tappet 41, having a thickened valve body 41*e* is biased by means of the return spring 41*a* in the direction towards a valve seat 39*a* and towards the valve tappet 41. The return spring 41*a* may be arranged in a blind hole 42*f* of the piston rod section 42*d*. The connection line 38 extends through the wall of the one piston rod section 42*c*, through the valve seat, partially through the blind hole 43*f* and through the possibly two-part wall of the other piston rod section 42*b* and thus, with open valve 39, connects the two working chambers 36, 37 with one another, the cross-sectional size of which is the same, since the piston rod sections 42*c*, 42*d* are also of the same cross-sectional size. The piston chamber 37 is bounded by a dividing wall fixedly arranged in the hollow cylinder of the piston cylinder 34*a*, 34*b*, which dividing wall is penetrated by the piston rod section 42*d* in a hole, in a sealed manner, whereby the piston rod may enter into a free chamber 34*c* arranged therebehind. If the valve tappet 41 is pushed to the right by a few millimetres into the position 41*c* (in FIG. 7) shown by a broken line, the valve 39 is opened and the piston 35 can be selectively freely displaced in both directions with the piston rod sections 42*c*, 42*d* and with the valve tappet 41, whereby the fluid medium, e.g. oil, flows over through the valve opening. If the valve tappet 41 is released, the valve 39 closes self-actingly by means of the spring force. By these means the piston rod 42 can be blocked against a displacement in any desired stroke position, whereby the fixing or blocking of the first or second joint 24, 25 is effected.

The piston cylinders 34*a*, 34*b* are each pivotally connected with the two joint parts of the associated joint 24, 25, whereby the connection points each have a spacing or off-set V1, V2 (FIG. 2) from the joint axis of the associated joint 24, 25. Due to this arrangement, upon a pivot movement of the link 23 and/or the base body 8, the associated cylinder piston is pushed in or pushed out, in each case according to the pivot direction provided. This is, however, only possible if the valve 39 is open. With the valve 39 closed, the respective joint 24, 25 is blocked by means of the associated piston cylinder 34*a*, 34*b*. For un-locking the joint and opening of the valve 39, the associated valve tappet 41 is so moved, by means of a manual actuation of an actuating member 45, in this case pushed in, that the valve 39 is opened. The actuating member 45 is subject to an elastic return force, effective on it indirectly or directly, which e.g. may be produced by means of a return spring acting on the actuating member 45. As soon as the manual pressure on the actuating member 45 is reduced or the body part 8*a* is let go, the actuating member 45 moves self-actingly into its initial position, in which the self-actingly closing valve 39 is closed.

An actuating member 45 may be associated with each piston cylinder 34*a*, 34*b*. For the purpose of simplification of handling and also for the purpose of making possible one-handed operation it is of advantage to associate with the two piston cylinders 34*a*, 35*a* a common actuating member 45, upon the actuation of which both valves 39 open and both joints 24, 25 are unlocked. By means of the release of the common actuating member 45, both joints 24, 25 are self-actingly blocked.

With the present exemplary embodiment, the piston cylinder 34*a* is connected with the base part 27 by means of a third joint 46, the third joint 46 being offset with reference to the first joint 24, transversely of the link 23, so that the first, the second and the third joints 24, 25, 46 form the corners of an imaginary triangle. With the present exemplary embodiment, as can best be seen in FIG. 2, the third joint 46 is, with regard to the first joint 24, downwardly offset by an offset amount V1. The other or rearward end of the piston cylinder 34*a* is connected with the link 23 by means of a fourth joint 47, which is preferably integrated in the second joint 25. For this purpose there serves a transverse head 48*a* connected with, preferably screwed onto, the associated end of the piston cylinder 34*a*, here connected with its piston rod 42, which transverse head penetrates to the outside the link 23*a* and the base body web 31*a* by means of one transversely through-going or two side joint bolts 49, whereby at the same time the second joint 25 and the fourth joint 47 are formed. Preferably, for forming the second joint 25, the link 23 and/or the base body carrier 31 is formed angle-shaped with limbs directed towards one another. By these means, in the pivoted-in condition, a compact construction is attained as can be seen in particular from FIG. 2. With the present exemplary embodiment, the base body webs 31*a* are formed angle-shaped with the web extensions 31*c* extending transversely or obliquely downwardly.

Figure 5:
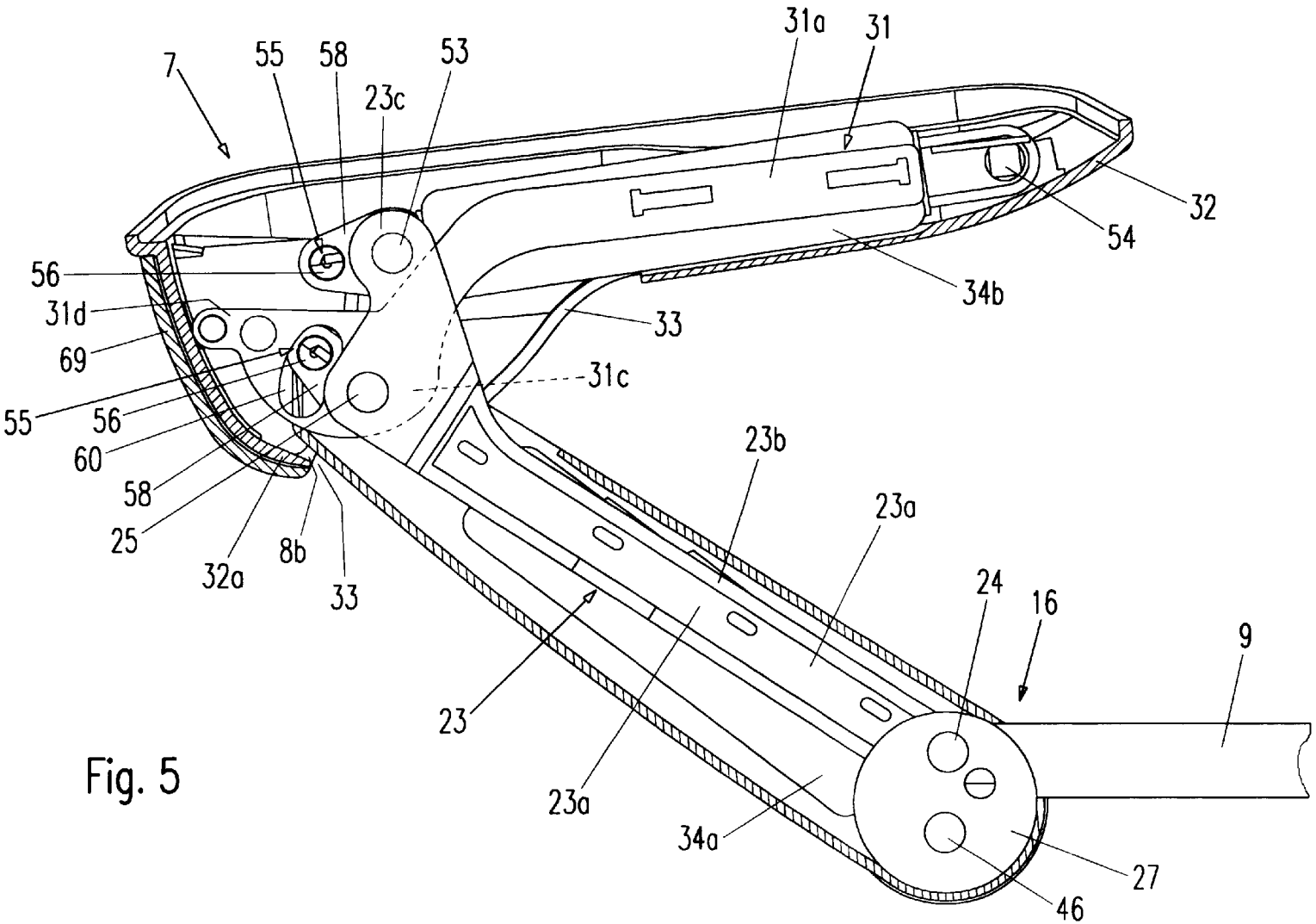
FIG. 5 shows the head support of FIG. 2 in a somewhat enlarged illustration and in a pivoted out support position.

In principle, in the same manner the upper piston cylinder 34*b* is connected with the link 23 with its rearward end with the offset amount V2 with regard to the second joint 25. For this purpose the link 23 has the upwardly angled projecting web extensions 23*c*, most clearly seen in FIG. 5, which have joint holes 51 in which there is mounted a transverse head 48*b*, corresponding to the transverse head 48*a*, by means of one through-going or two side bolts 52, whereby the transverse head 48*b* is connected to, in particularly screwed onto, the piston rod 42 of the piston cylinder 34*b*. By these means there is formed a fifth joint 53 for the piston cylinder 34*b*, which with regard to the second joint 25 is transversely offset, here upwardly offset, by the amount V2. The forward end of the piston cylinder 34*b* is mounted on the base body shell 32, which in the present embodiment is formed self-supporting, in a sixth joint 54, formed on the base body shell, pivotable in the pivot plane. The second, the fifth and the sixth joints 25, 53, 54 are likewise located at the corners of an imaginary triangle.

Figure 6:
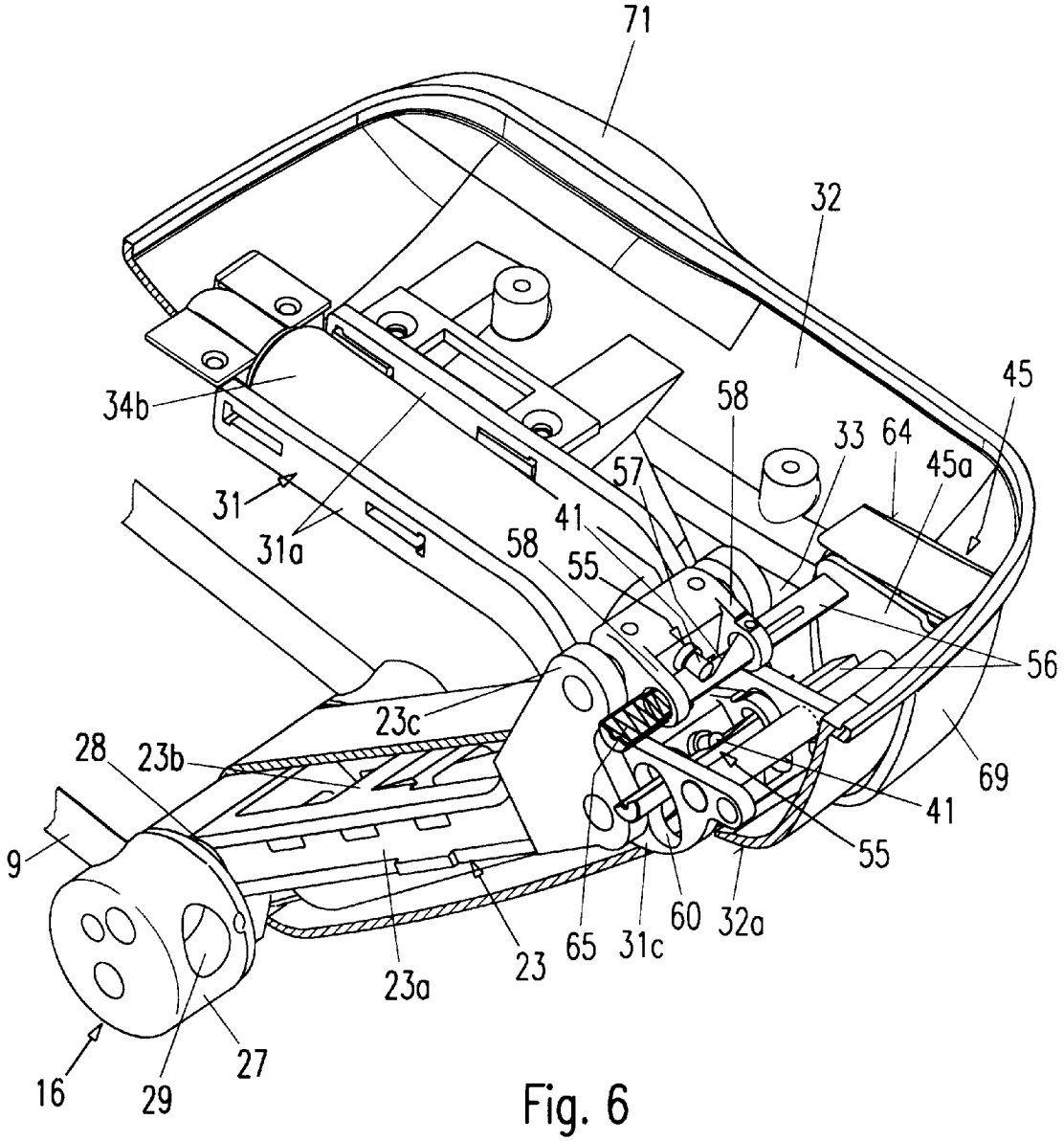
FIG. 6 shows the head support of FIG. 2 in a perspective illustration viewed from behind and obliquely from above.

Both piston cylinders 34*a*, 34*b* are arranged with their piston rods 42 directed rearwardly, so that the valve tappets 41 are arranged near to one another and can preferably be operated in common by means of the actuating member 45. Since the movement direction of the actuating member 45 is directed at right angles to the pivot direction, and the movement direction of the valve tappet 41 lies in the pivot plane, there is needed a transmission mechanism 45 between the actuating member 45 and the valve tappet or tappets 41. Since, furthermore, the contact ends 41*b* of the valve tappets 41 projecting out of the piston rods 42 carry out circular arc-section-like movement during the pivoting, there is needed a configuration of the actuating member 45 such that it is connected with the associated, preferably with both transmission mechanisms 45, in any pivot position. For this purpose there serves an actuating plate 45*a* arranged on the actuating member 45, the actuation surface of which actuating plate extends parallel to the pivot plane or longitudinal middle plane E. The actuating plate 45*a* is so sized that it stands in drive connection with the transmission mechanism or transmission mechanisms 55 in any pivot position. With the present exemplary embodiment, a transmission mechanism 55 is present for each piston cylinder 34*a*, 34*b* that is formed by means of an actuation bolt 56 movable in a guide transversely to the pivot plane, the end of which actuation bolt towards the actuating member 45 bears on the actuating plate 45*a* and which has a curve or oblique surface 57 which stands so in contact with the contact end 41*b* that upon a movement of the actuating member 45 inwardly the valve 39 is opened. The return of the actuation bolt 56 can be effected by means of a spring which through the actuation bolt 56 can also serve for the return movement of the actuating member 45. As can be seen in FIG. 6, the actuation bolt 56 is mounted in mounting walls 58 arranged to both sides of the associated contact end 41*b* on the transverse head 48*a* or 48*b*, in guide holes formed in the mounting walls. For preventing a rotation of the actuation bolt 56 there is provided between it and one of the mounting walls 58 a rotation stop which is formed by means of a pin penetrating through the associated mounting wall 58 and a slot in the actuation bolt 57. The other transmission mechanism 55 is correspondingly formed.

The actuating member 45 is guided in a guide 61 on the base body carrier 31 and/or on the base body shell 32 or attached parts thereof. In the present exemplary embodiment, the guide 61 is formed by means of two guide holes 62*a*, 62*b* in a rearwardly extended extension member 23*d* of the link 23 or of the link web 23*a*, whereby the actuating member 45 has two inwardly projecting guide rods 63*a*, 63*b* which fit into the guide holes 62*a*, 62*b*. For the guiding, or additional guiding, there may serve also an opening edge 64 of an opening into which the actuating member 45 can be inserted, see FIG. 6. An extension spring 65 may be provided as return spring, which may be arranged between a mounting wall 58 away from the actuating member 45 and the associated actuation bolt 56, and which may be attached to these two parts with its ends.

If the extension parts 31*c* are located in the region of a neighbouring actuation bolt 56, there is needed a e.g. curved elongate hole 60 in the extension parts 31*d* through which the associated end of the actuating bolt 56 may extend (FIG. 6).

Figure 4:
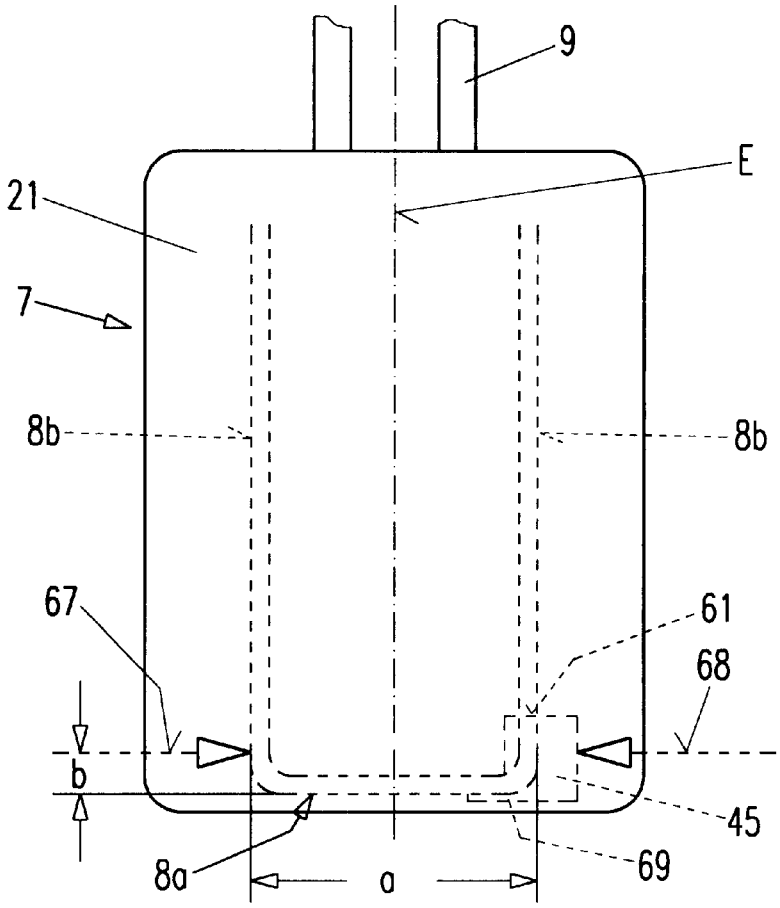
FIG. 4 shows the head support of FIG. 2 viewed from above.

On the one hand, the dimension a (FIG. 4) measured horizontally above the body part 8*a* and the actuating member 45 and, on the other hand, the mean spacing b of the actuating member 45 from the rear side of the body part 8*a*, are only of such size that the body part 8*a* and the actuating member 45 can be gripped over with the operating hand from below or from behind and the pushing-in movement of the actuating member, indicated by means of the arrow 68, can be carried out manually in a readily manipulable manner. Thereby, one or more fingers of the operating hand exercise a counter-force on the opposite side of the body part 8*a*, indicated by the arrow 67. In this operating position, the joints 24, 25 are unlocked, and the head support 7 can, with one and the same operating hand in the case of one-handed operation, be pivoted into the desired pivot position or support position. As soon as the actuating member 45 is released it returns back into its initial position due to the elastic spring force, whereby the joints 24, 25 self-actingly block.

In particular the link 23 can be clad by means of the covering parts 68 illustrated in FIG. 2, in order to avoid finger injuries and/or to improve the appearance of the head support 7.

69 designates a limb formed on, in one piece, on the actuating member, which limb engages over the joint shell 32 on the outside and covers over the associated edge of the guide hole for the actuating member 45.

In order to facilitate handling even in difficult positions of the head support 7, there may be arranged on the head support, in particular to both sides, e.g. ledge-like grip parts 71 which may be attached to the base body 8 or the base body-shell 32, preferably being formed thereon.

Finally, there are described further following advantages.

A step-less setting is attained, whereby a mechanical ratcheting is not required.

A reliable operation is possible.

A horizontal transition from the head cushion 21 to the backrest cushion can be set (treatment of children).

The head cushion 21 can be pushed directly onto the backrest cushion.

Operation and setting can also be effected under high loads.

A simple mounting and dismounting is possible.

What is claimed is:

1. Head support for a medical or dental-medical treatment chair having a backrest and a head support, the head support being pivotally connected with the backrest by means of a pivot device having a first joint, and being fixable in a respective pivot position by means of a fixing device, wherein the fixing device has a piston cylinder with two working chambers, the piston cylinder being connected with the first joint, and wherein the working chambers are connected with one another by a connection line in which a valve is disposed that can be selectively opened and closed, and wherein an actuating member is provided for the selective opening and closing of the valve.

2. Head support according to claim 1, wherein the actuating member is positioned at one side of a grip part disposed on the head support and, together with the grip part, is adapted for being gripped over by a thumb and at least one finger of an operating hand, and is movable by manual exercise of pressure against a return force.

3. Head support according to claim 2, wherein the grip part is disposed on an underside of the head support.

4. Head support according to claim 1, wherein the pivot device has a second joint which is fixable by a second fixing device, and is releasable by an actuating member.

5. Head support according to claim 4, further comprising a common actuating member for both fixing devices.

6. Head support according to claim 4, the pivot device including a link having a first end and a second end, wherein the first joint and the second joint are disposed at the ends of the link.

7. Head support according to claim 6, wherein the second joint is disposed on an angled limb of the second joint.

8. Head support according to claim 4, wherein the second fixing device has a piston cylinder with two working chambers, and wherein the piston cylinder is connected with the second joint, and whereby the working chambers are connected with one another by a connection line in which a valve is disposed, and wherein the valve can be selectively opened and closed by the actuating member.

9. Head support according to claim 1, wherein the actuating member is disposed on a longitudinal side with respect to the head support.

10. Head support according to claim 1, wherein the connection line extends through the piston of the piston cylinder.

11. Head support according to claim 10, wherein the valve is disposed in the piston or in the piston rod of the piston cylinder.

12. Head support according to claim 11, further comprising a valve tappet longitudinally displaceably guided in the piston rod.

13. Head support according to claim 1, wherein the actuating member is movable transversely to the longitudinal axis of the piston cylinder, and wherein a transmission mechanism is provided between the actuating member and the valve which transforms movement of the actuating member into a movement of a valve tappet for the valve running in the longitudinal direction of the piston cylinder.

14. Head support according to claim 13, wherein the actuating member has an actuating surface extending preferably parallel to the pivot plane, and wherein the actuating surface is of sufficient size to actuate one of the valve, the valve tappet, or the transmission mechanism in any pivot position.

15. Head support according to claim 1, wherein the piston cylinder is pivotally connected to the first joint.

16. Medical or dental-medical treatment chair having a backrest and a head support, the head support being pivotally connected with the backrest by a pivot device having a first joint, and being fixable in a respective pivot position by a fixing device, wherein the fixing device has a piston cylinder with two working chambers, wherein the piston cylinder is connected with the first joint, wherein the working chambers are connected with one another by a connection line in which a valve is disposed that can be selectively opened and closed, and wherein an actuating member is provided for the selective opening and closing of the valve.

* * * * *

UNITED STATES PATENT AND TRADEMARK OFFICE

CERTIFICATE OF CORRECTION

PATENT NO. : 6,520,585 B1 
DATED : February 18, 2003
INVENTOR(S) : Georg Hummler et al.

It is certified that error appears in the above-identified patent and that said Letters Patent is hereby corrected as shown below:

Title page,
Item [73], should read:

-- [73] Assignee: Kaltenbach & Voigt GmbH & Co., Biberach (DE) --

Signed and Sealed this

Fifteenth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,520,585 B1
APPLICATION NO. : 09/813733
DATED : February 18, 2003
INVENTOR(S) : Georg Hummler et al.

It is certified that error appears in the above-identified patent and that said Letters Patent is hereby corrected as shown below:

On the title page, Item (12):

Please delete "Georg et al." and replace with --Hummler et al.--.

At page 1, (75) Inventors:

Please delete "Hummler Georg" and replace with --Georg Hummler--.

Please delete "Von Bank Reinhold" and replace with --Reinhold Von Bank--.

Please delete "Rapp Karlheinz" and replace with --Karlheinz Rapp--.

Signed and Sealed this

Eighth Day of August, 2006

JON W. DUDAS
*Director of the United States Patent and Trademark Office*